US008500942B2

(12) United States Patent
Grynaeus et al.

(10) Patent No.: US 8,500,942 B2
(45) **Date of Patent: *Aug. 6, 2013**

(54) FUSIBLE TEXTILE FABRIC

(75) Inventors: Peter Grynaeus, Birkenau (DE); Oliver Staudenmayer, Weinheim (DE); Hans Rettig, Laudenbach (DE)

(73) Assignee: Carl Freudenberg KG, Weinheim (DE)

( * ) Notice: Subject to any disclaimer, the term of this patent is extended or adjusted under 35 U.S.C. 154(b) by 394 days.

This patent is subject to a terminal disclaimer.

(21) Appl. No.: 12/742,207

(22) PCT Filed: Jul. 29, 2008

(86) PCT No.: PCT/EP2008/006235

§ 371 (c)(1),
(2), (4) Date: Sep. 29, 2010

(87) PCT Pub. No.: WO2009/059651

PCT Pub. Date: May 14, 2009

(65) Prior Publication Data

US 2011/0005674 A1 Jan. 13, 2011

(30) Foreign Application Priority Data

Nov. 9, 2007 (DE) ..... 10 2007 053 914
Dec. 21, 2007 (DE) ..... 10 2007 062 865

(51) Int. Cl.
*B29C 65/52* (2006.01)
*B05D 1/32* (2006.01)
*D04H 1/66* (2012.01)

(52) U.S. Cl.
USPC ..... 156/279; 156/296; 427/288

(58) Field of Classification Search
USPC ..... 156/279, 296; 427/288
See application file for complete search history.

(56) References Cited

U.S. PATENT DOCUMENTS

| | | | | |
|---|---|---|---|---|
| 3,228,790 | A | 1/1966 | Sexsmith et al. | |
| 5,290,594 | A | 3/1994 | Groshens et al. | |
| 5,403,640 | A | 4/1995 | Krishnan et al. | |
| 5,439,737 | A * | 8/1995 | Trabelsi | 428/317.7 |
| 5,505,999 | A | 4/1996 | Krishnan et al. | |
| 5,569,348 | A | 10/1996 | Hefele | |
| 6,986,935 | B2 | 1/2006 | Kalbe et al. | |
| 8,135,997 | B2 | 3/2012 | Kim et al. | |
| 8,354,144 | B2 * | 1/2013 | Grynaeus et al. | 427/389.9 |
| 2009/0100565 | A1 | 4/2009 | Grynaeus et al. | |
| 2010/0088552 | A1 | 4/2010 | Kim et al. | |
| 2011/0005674 | A1 | 1/2011 | Grynaeus et al. | |

FOREIGN PATENT DOCUMENTS

| | | | |
|---|---|---|---|
| CA | 1182068 | A1 | 2/1985 |
| DE | 102005030484 | A1 | 1/2007 |
| EP | 0153443 | A2 | 9/1985 |
| EP | 0675183 | A1 | 10/1995 |
| GB | 1379660 | A | 1/1975 |
| GB | 1474455 | A | 5/1977 |
| JP | 2011503371 | A | 11/1927 |
| JP | 55163251 | A | 12/1980 |
| JP | 5742114 | A | 3/1982 |
| JP | 57121662 | A | 7/1982 |
| JP | 093781 | A | 1/1997 |
| JP | 0959810 | A | 3/1997 |
| JP | 9158055 | A | 6/1997 |
| JP | 09158055 | A | 6/1997 |
| JP | 2004092010 | A | 3/2004 |
| JP | 2004-300589 | A * | 10/2004 |
| JP | 2010532448 | A | 10/2010 |
| JP | 2010532503 | A | 10/2010 |
| WO | WO 9506155 | A1 | 3/1995 |

OTHER PUBLICATIONS

International Search Report for PCT/EP2008/006235 mailed on Mar. 13, 2009.
Pössnecker, Gerhard Klebstoffe für Einlagen, ITB Vleisstoffe—Technische Textilien, 1999, Heft 2, S. 16-20.
International Search Report for PCT/EP2008/009480 mailed on Jul. 8, 2009.
DIN 54310; Test of Textiles; "Delamination of fusible interlining from the outer fabric"; Mechanical delamination test: DIN Deutsches Institut fuer Normung e. V., Berlin; pp. 1-9; Jul. 1980.
DIN EN ISO 6330:2010-01; "Textiles—Domestic washing and drying procedures for textile testing (ISO 6330-2012)"; DIN Deutsches Institut fuer Normung e. V., Berlin; pp. 1-40; Aug. 2012.
Japanese Office Action dated May 16, 2013.

* cited by examiner

*Primary Examiner* — Michael Tolin
(74) *Attorney, Agent, or Firm* — Leydig, Voit & Mayer, Ltd.

(57) ABSTRACT

A method for forming a textile fusible sheet material includes producing a fibrous web from fibers on a laydown apparatus so as to form a backing ply and applying a mixture of a binder and a thermoplastic polymer to selected areal regions of the fibrous web. The method further includes thermally treating the fibrous web so as to dry and bond the fibers of the fibrous web using the binder to form a bonded fibrous web nonwoven fabric and so as to sinter the thermoplastic polymer with a surface of the bonded fibrous web nonwoven fabric.

16 Claims, 1 Drawing Sheet

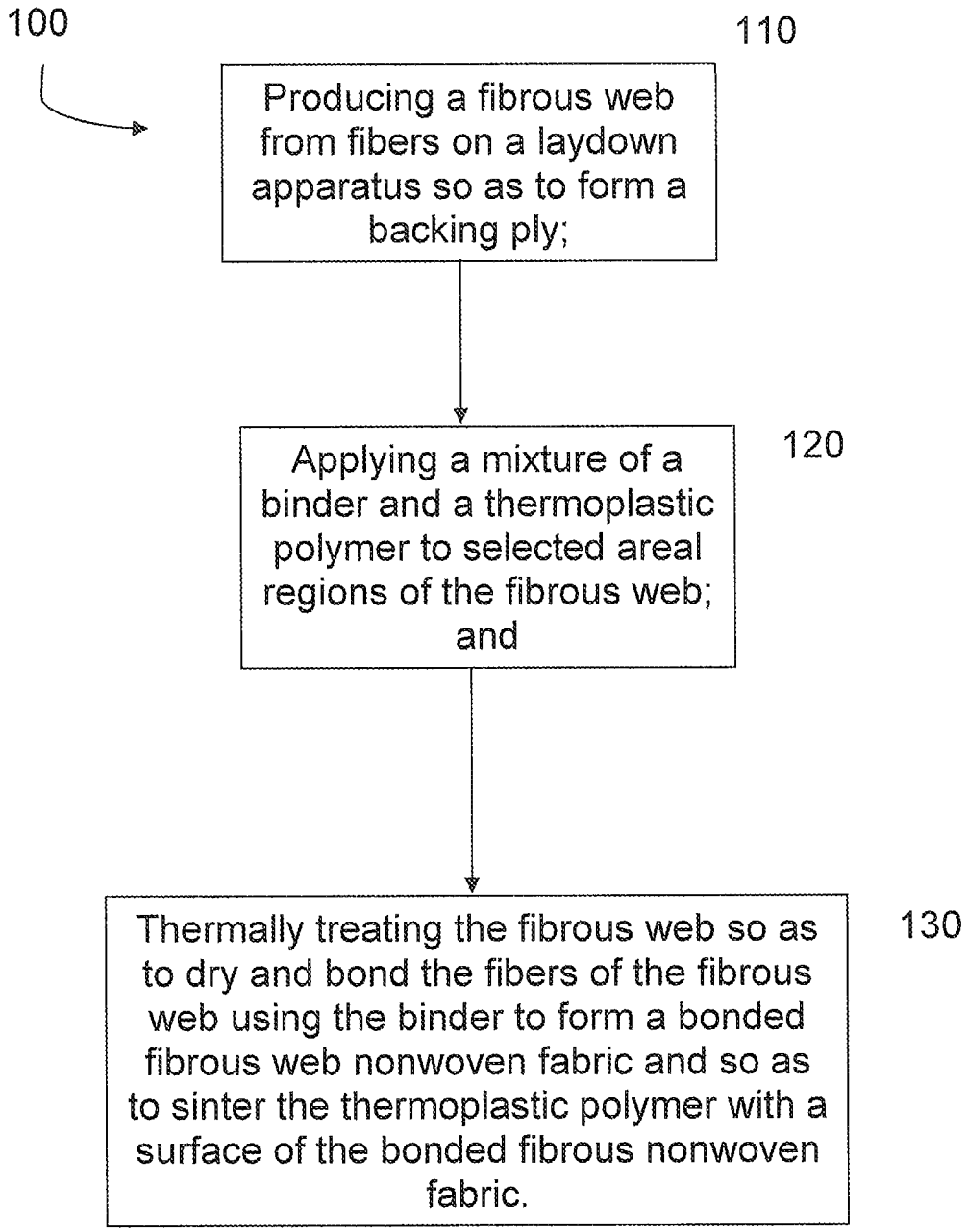
100
110
Producing a fibrous web from fibers on a laydown apparatus so as to form a backing ply;
120
Applying a mixture of a binder and a thermoplastic polymer to selected areal regions of the fibrous web; and
130
Thermally treating the fibrous web so as to dry and bond the fibers of the fibrous web using the binder to form a bonded fibrous web nonwoven fabric and so as to sinter the thermoplastic polymer with a surface of the bonded fibrous nonwoven fabric.

FUSIBLE TEXTILE FABRIC

This application is a U.S. National Phase application under 35 U.S.C. §371 of International Application No. PCT/EP2008/006235, filed Jul. 29, 2008, which claims benefit to German Patent Application No. DE 10 2007 053 914.4, filed Nov. 9, 2007 and German Patent Application No. DE 10 2007 062 865.1, filed Dec. 21, 2007. The International Application was published in German on May 14, 2009 as WO 2009/059651 under PCT Article 21 (2).

This invention relates to a textile fusible sheet material, especially useful as a fusible interlining in the textile industry, comprising a backing ply composed of a fibrous web bonded in selected areal regions by means of a binder and nonbonded in the remaining areal regions, the backing ply having a thermoplastic polymer provided on at least part of at least one side.

BACKGROUND

Interlinings are the invisible scaffolding of clothing. They ensure correct fit and optimal wearing comfort. Depending on application, they augment processibility, enhance functionality and stabilize clothing. In addition to clothing, these functions can find application in industrial textile applications, for example furniture, upholstery and home textiles.

Important properties required of interlinings are softness, springiness-type hand, wash and care durability and also adequate abrasion resistance on the part of the backing material in use.

Interlinings can consist of bonded fibrous web nonwoven fabrics, wovens, formed-loop knits or comparable textile sheet materials, which are usually additionally provided with a bonding compound whereby the interlining can be adhered to a top fabric usually thermally via heat and/or pressure (fusible interlining). The interlining is thus laminated onto a top fabric. The various textile sheet materials mentioned have different property profiles, depending on their method of making. Woven fabrics consist of threads/yarns in the warp and weft directions, formed-loop knits consist of threads/yarns connected via a loop construction into a textile sheet material. Bonded fibrous web nonwoven fabrics consist of individual fibers laid down to form a fibrous web which are bonded mechanically, chemically or thermally.

In the case of mechanically bonded fibrous web nonwoven fabrics, the fibrous web is consolidated by mechanical interlacing of the fibers. This utilizes either a needling technique or an interlacing by means of jets of water or vapor. Needling does give soft products, albeit with relatively labile hand, so that this technology has become established for interlinings only in quite specific niches. In addition, mechanical needling requires typically basis weight>50 g/m$^2$, which is too high for a multiplicity of interlining applications.

Bonded fibrous nonwoven fabrics consolidated using jets of water can be produced in lower basis weights, but generally are flat and lack springiness.

In the case of chemically bonded fibrous web nonwoven fabrics, the fibrous web is treated with a binder (an acrylate binder for example) by impregnating, spraying or by means of other customary methods of application, and subsequently cured. The binder binds or bonds the fibers together to form a bonded fibrous web nonwoven fabric, but has the consequence that a relatively stiff product is obtained, since the binder is widely distributed throughout the fibrous web and adheres the fibers together throughout as in a composite material of construction. Variations in hand/softness cannot be fully compensated via fiber blends or binder choice.

Thermally bonded fibrous web nonwoven fabrics are typically calender or hot air consolidated for use as interlinings. The current standard technology for nonwoven interlinings is pointwise calender consolidation. The fibrous web here generally consists of polyester or polyamide fibers specifically developed for this process, and is consolidated by means of a calender at temperatures around the melting point of the fiber, one roll of the calender having a point engraving. Such a point engraving consists for example of 64 points/cm$^2$ and can have a sealing surface of 12% for example. Without a point arrangement, the interlining would be consolidated flattish and be unsuitably harsh in hand.

The point arrangement ensures that sufficiently soft products are formed, depending on fibers used, but the bonded fibrous web nonwoven has a point pattern (point-seal repeat). The softness of the interlining is attributable to the mobility of the fibers between the bonding points. The bonding point, consolidated in the manner of a foil, contributes to the stiffening, however. Furthermore, these point patterns can be unattractively visible through very lightweight, thin top fabrics. In addition, a bonding compound is likewise applied pointwise, by printing, in a further additional operation. The two different point structures can create a visually disturbing (moiré) effect when they overlap. Sufficiently soft interlinings having an attractive hand are obtained, but with the standard technology it is typically about 10-45% of the interlining which is consolidated and covered by means of point-seal repeats and bonding compound point application.

The above-described different processes for producing textile sheet materials are known and described in textbooks and in the patent literature.

The bonding compounds typically applied to interlinings are thermally activatable and consist generally of thermoplastic polymers. The technology for applying these bonding compound coatings is effected according to the prior art in a separate operation onto the fibrous sheet material. By way of bonding compound technology it is typically powder point, paste printing, double point, sprinkling, hotmelt processes which are known and described in the patent literature. Double point coating is currently considered to be the most effective with regard to adherence to the top fabric after caring treatment.

Such a double point has a two-layered construction in that it consists of an underpoint and an overpoint. The underpoint penetrates into the base material and serves as blocking layer against bonding compound strike-back and to anchor the overpoint particles. Customary underpoints consist of binder and/or are polymer-filled mixtures. Depending on the chemistry used, the underpoint contributes to the adhesive bond formed with the top fabric as well as to the anchoring in the base material. However, it is the overpoint which is the main adhesive component in the two-layered composite and which is sprinkled as a powder onto the underpoint. After sprinkling, the excess portion of the powder (between the points of the lower layer) is sucked off again. After subsequent sintering, the overpoint is thermally bonded on the underpoint and can serve as adhesive material in respect of the top fabric.

Depending on the intended purpose of the interlining, different numbers of points are printed and/or the amount of bonding compound or the geometry of the point pattern is varied. A typical number of points is, for example, CP 110 for an add-on of 9 g/m$^2$, or CP 52 having an add-on range of 11 g/m$^2$.

The process described does provide textile fusible sheet materials which, when used as interlining, have high bond strength, but the manufacturing process is inconvenient and costly.

SUMMARY OF THE INVENTION

An aspect of the present invention is to provide a textile fusible sheet material, especially for use as a fusible interlining in the textile industry, which has very good haptic and optical properties and very high bond strength to a top fabric and, what is more, is simple and inexpensive to produce.

According to the invention, a textile fusible sheet material, especially useful as a fusible interlining in the textile industry, having a backing ply composed of a fibrous web bonded in selected areal regions by means of a binder and nonbonded in the remaining areal regions, the backing ply having a thermoplastic polymer provided on at least part of at least one side, is obtainable by a process comprising steps of:

a) producing a fibrous web from fibers on a laydown apparatus in a conventional manner,
b) applying a mixture of binder and thermoplastic polymer to selected areal regions of the fibrous web, and
c) thermally treating the fibrous web obtained from step b) to dry and bond fibers of the fibrous web by means of the binder to form a bonded fibrous web nonwoven fabric and optionally crosslinking the binder and to sinter the thermoplastic polymer onto and together on/with the surface of the bonded fibrous web nonwoven fabric.

BRIEF DESCRIPTION OF THE DRAWING

The FIGURE shows a preferred process for producing a textile fusible sheet material according to the present invention.

DETAILED DESCRIPTION

The advantages of the present invention will now be described without loss of generality using a point printing process as an example.

The textile fusible sheet material of the present invention is notable for high bond strength. It has been determined that, surprisingly, a bonding point composed of binder and thermoplastic polymer acting as bonding compound has comparable bond strength to the conventional bonding compound point of 3P/double point structure. In contrast to the latter, however, the bonding point of the present invention can be applied in a single-step process with this process step additionally comprising at the same time the application of the binder to produce the bonded fibrous nonwoven fabric from the fibrous web. The textile fusible sheet material of the present invention hence is additionally simple and inexpensive to produce.

The result of the bonding point of binder and thermoplastic polymer concurrently also partially forming the fiber bonding point is a maximum of possible mobility of the fibers between the consolidation points. The textile sheet material accordingly has high springiness, high softness and a pleasant hand. Since the textile sheet material, in contradistinction to the known interlinings, does not have an additionally applied grid of points, the undesirable moiré effect known from the prior art also does not occur even in the case of using sheer top fabrics. As a result, the textile sheet material of the present invention offers a pleasant visual appearance.

Since bonding with a binder is concerned, there is no need for expensive specialty fibers as in the case of the thermal consolidation by the point-seal process, yet rather elastic products are also obtainable with specifically crimped fibers for example.

The ratio of the amount of binder used to the amount of thermoplastic polymer and the variation of the wettability of the fibrous web make it possible to obtain very severely bonded, abrasion-resistant products and very soft bonded fibrous web nonwoven fabrics having surfaces which can correspond to raised wovens. High proportions of thermoplastic polymer make it possible to achieve very high delamination resistances. By modifying the surface of the preferably particulate thermoplastic polymer, directly or indirectly from the liquor, its incorporation into the binder matrix can be varied. Very high occupation of the particle surface by other components of the binder matrix is deleterious to the bonding forces which are attainable.

The choice of the fibers to be used for the backing ply, of the binder and of the thermoplastic polymer is made in view of the respective intended application and/or the particular quality requirements. The invention in principle imposes no limits here whatsoever. A person skilled in the art is readily able to find the combination of materials which is suitable for his or her purposes.

The fibers for the fibrous web may comprise for example manufactured fibers, such as polyester, polyamide, regenerated cellulose and/or binder fibers and/or natural fibers, such as wool or cotton fibers. The manufactured fibers may comprise crimpable, crimped and/or uncrimped staple fibers, crimpable, crimped and/or uncrimped directly spun continuous filament fibers and/or finite fibers, such as metlblown fibers.

The fibrous web may have a single- or multi-ply construction.

Of particular suitability for interlinings are fibers having a fiber linear density of up to 6.7 dtex. Coarser linear densities are normally not used on account of their considerable fiber stiffness. Preference is given to fiber linear densities in the region of 1.7 dtex, but microfibers having a linear density<1 dtex are also conceivable.

The binder can be a binder of the acrylate, styrene-acrylate, ethylene-vinyl acetate, butadiene-acrylate, SBR, NBR and/or polyurethane type.

The thermoplastic polymer acting as bonding compound preferably comprises (co)polyester-, (co)polyamide-, polyolefin-, polyurethane-, ethylene vinyl acetate-based polymers and/or combinations (mixtures and chain growth addition copolymers) of the polymers mentioned.

The mixture of binder and thermoplastic polymer is preferably applied to the backing ply in a point pattern, as described above. This ensures the softness and springiness of the material. The point pattern can be regularly or irregularly distributed. However, the present invention is in no way restricted to point patterns. The mixture of binder and thermoplastic polymer can be applied in any desired geometries, including for example in the form of lines, stripes, net- or lattice-type structures, points having rectangular, diamond-shaped or oval geometry or the like.

The FIGURE shows a preferred process 100 for producing a textile fusible sheet material according to the present invention. In a first step 110, a fibrous web is produced from fibers on a laydown apparatus so as to form a backing ply. In a second step 120, a mixture of a binder and a thermoplastic polymer is applied to selected areal regions of the fibrous web. In a third step, 130, the fibrous web is thermally treated so as to dry and bond the fibers of the fibrous web using the binder to form a bonded fibrous web nonwoven fabric and so as to sinter the thermoplastic polymer with a surface of the bonded fibrous web nonwoven fabrics.

When staple fibers are used, it is advantageous to card them with at least one roller card to form a fibrous web. Random lapping is preferable here, but combinations of longitudinal and/or transverse lapping and/or even more complicated roller card arrangements are also possible when specific bonded fibrous web nonwoven fabric properties are to be made possible, and/or when multi-ply fibrous structures are desired.

This nonbonded fibrous web can be printed with the mixture comprising the binder and the thermoplastic polymer directly in a printing machine. It can possibly be sensible for this purpose for the fibrous web prior to printing to be compressed, wetted with textile auxiliaries or treated in any other desired manner so as to produce in the bonded fibrous web an increased mechanical fiber-fiber adherence which renders the printing operation more consistent.

Preferably, the mixture for printing is present in the form of a dispersion. Since the exact printing of nonbonded fibrous webs is difficult, the dispersion components used have to be exactly matched to the fibrous substrate and to the thermoplastic polymers used.

The dispersion used preferably comprises

- crosslinking or crosslinkable binders of the acrylate, styrene-acrylate, ethylene-vinyl acetate, butadiene-acrylate, SBR, NBR and/or polyurethane type, and also
- auxiliaries
  - such as thickeners (for example partially crosslinked polyacrylates and salts thereof),
  - dispersants,
  - wetting agents,
  - flow control agents,
  - hand modifiers (for example silicone compounds or fatty acid ester derivatives) and/or
  - fillers
- and one or more thermoplastic polymers acting as bonding compound.

The thermoplastic polymer is preferably present in the form of particles. It has been determined that, surprisingly, as the fibrous web is printed with a dispersion of the particles and the binder and as the case may be still further components, the binder separates from the coarser particles and the coarser particles come to rest more on the upper side of the bonding area, for example the point surface. The binder, in addition to becoming anchored in the fibrous web and bonding the fibrous web together to form a bonded fibrous web nonwoven fabric, also binds the coarser particles. At the same time, a partial separation of the particles and binder occurs at the surface of the fibrous web. The binder penetrates more deeply into the material, while the particles accumulate at the surface. As a result, the coarser particles of polymer are bound into the binder matrix, but at the same time their free area at the surface of the bonded fibrous web nonwoven fabric is available for direct adhesive bonding to the top fabric. A structure resembling a double point comes to be developed but in contrast to the production of this structure in the known double point process, only a single process step is required which, furthermore, serves to apply the binder at the same time. Double-layered bonding compound points are notable for a low strike-back of bonding compound, since the layer applied first acts as a blocking layer. Surprisingly, the bonding point of the present invention, which resembles the double point, also displays this positive property. Evidently, the process described herein results in an in situ formation of a blocking layer in the bonding point; the strike-back of thermoplastic polymer is effectively braked; and the positive properties of the product are enhanced as a result.

The size of the particles is decided according to the area to be printed, for example the desired size of a bonding point. In the case of a point pattern, the particle diameter can vary between >0μ and 500μ. In principle, the particle size of the thermoplastic polymer is not unitary, but has a distribution, i.e., always has a spectrum of particle sizes. The limits recited above are the respective main fractions. The particle size has to be matched to the desired application rate and point distribution.

The binders used can vary in their glass transition point, but for soft products it is customary to prefer "soft" binders having a Tg<10° C. The auxiliary materials serve to adjust the viscosity of the paste. Suitable binders make it possible to vary the haptics of the interlining between wide limits.

Following the printing operation, the material is subjected to a thermal treatment to dry and bond fibers of the fibrous web by means of the binder to form a bonded fibrous web nonwoven fabric and optionally crosslinking the binder and to sinter the thermoplastic polymer onto and together on/with the surface of the bonded fibrous web nonwoven fabric. Next the material is wound up as a fusible textile sheet material.

However, the use of a fusible textile sheet material of the present invention is not restricted to this application. Other applications are conceivable, for example as a fusible textile sheet material in home textiles such as upholstered furniture, reinforced seating structures, seat covers or as fusible and stretchable textile sheet material in automotive interiors, shoe components or the hygiene/medical sector.

The invention will now be described without loss of generality using the example of a fusible textile sheet material of the present invention being used as a fusible interlining in the textile industry.

Test Methods Used:

Fusing the hereinbelow described illustrative embodiments to an in-house top fabric of the popelin type was done on a continuous press at 140° C. and 12 sec. Delamination resistance is determined on the lines of DIN 54310 or DIN EN ISO 6330. The delamination resistance values recited are marked "sp" when, in the delamination resistance test, the adherence between top fabric and interlining is so powerful that the interlining tears in the course of the test being carried out before delamination is complete. This is a maximum value to be targeted, since the adherence is in principle stronger than the inner strength of the interliner.

To determine bonding compound strike-back, an inner sandwich formed from the interliner with the top fabric on the outside, is passed through the fusing press according to the above-reported settings. The lower the adherence of the inner ply, the lower the bonding compound strike-back.

1st Illustrative Embodiment

A fibrous web having a basis weight of 35 g/m$^2$ and consisting of 20% of s/s (side-by-side) bicomponent fibers of 4.4 dtex 60 mm PET/coPET (polyester/copolyester) having differing thermal contraction and 80% of standard polyester fibers at 1.7 dtex 36 mm, roller-carded and calendered in a press system at 120° C., passes through a pair of rolls and is wetted with water to a wet pickup of 150%. The moist fibrous web next passes into a rotary screen printing machine at 110 points/cm$^2$ and is printed pointwise with a binder-polymer dispersion. The printed fibrous web is dried in a belt dryer at 175° C., the binder crosslinks and the polymer particles are sintered on and together.

The binder-polymer dispersion has the following composition:

| | |
|---|---|
| Self-crosslinking butyl/ethyl acrylate binder disp. with $t_g$ = −28° C. | 20 parts |

-continued

| | |
|---|---|
| Copolyamide powder (particle diameter from >0 up to 200μ with melting region around 115° C. | 20 parts |
| Wetting agent a//n/i | 1 part |
| Thickener | 3 parts |
| Water | 56 parts |

2nd Illustrative Embodiment

A fibrous web having a basis weight of 25 g/m$^2$ and consisting of 50% of nylon-6 fibers at 1.7 dtex 38 mm and 50% of PET (polyester) fibers at 1.7 dtex 34 mm, roller-carded and calendered in a press system at 150° C., passes through a pair of rolls where the bottom roll is a finely grooved scooping roll, and is wetted with water to a wet pickup of 110%. The moist fibrous web next passes into a rotary screen printing machine at 110 points/cm$^2$ and is printed pointwise with a binder-polymer dispersion. The printed fibrous web is dried in a belt dryer at 175° C., the binder crosslinks and the polymer particles are sintered on and together.

The binder-polymer dispersion has the following composition:

| | |
|---|---|
| Self-crosslinking butyl/ethyl acrylate binder disp. with $t_g$ = −28° C. | 15 parts |
| Copolyamide powder 0-120μ with melting region around 110° C. | 30 parts |
| Wetting agent a//n/i | 1 part |
| Thickener | 2 parts |
| Water | 52 parts |

3rd Illustrative Embodiment

A fibrous web having a basis weight of 40 g/m$^2$ and consisting of 30% of spiral-crimped copolyester fibers at 2.2 dtex 38 mm and 70% of PET (polyester) fibers at 1.7 dtex 34 mm, roller-carded and caldenered in a press system at 110° C., passes through a pair of rolls and is wetted with water+0.5% auxiliary to a wet pickup of 140%. The moist fibrous web next passes into a rotary screen printing machine at 37 points/cm$^2$ and is printed pointwise with a binder-polymer dispersion. The printed fibrous web is then dried in a belt dryer at 175° C., the binder crosslinks and the polymer particles are sintered on and together.

The binder-polymer dispersion has the following composition:

| | |
|---|---|
| Self-crosslinking butyl/ethyl acrylate binder disp. with $t_g$ = −28° C. | 10 parts |
| Self-crosslinking butyl/ethyl acrylate binder disp. with $t_g$ = −10° C. | 10 parts |
| Copolyamide powder 80-200μ with melting region around 120° C. | 45 parts |
| Wetting agent a//n/i | 1 part |
| Thickener | 2 parts |
| Water | 32 parts |

The product properties of the textile sheet materials produced as per the illustrative embodiments are recited in Table 1. Table 2 shows a comparison between a textile sheet material as per Example 1 and a thermally bonded comparative example.

TABLE 1

| | Example 1 | Example 2 | Example 3 |
|---|---|---|---|
| Points/cm$^2$ | 110 | 110 | 37 |
| Fiber blend. | 20% s/s bico PES 80% standard PES | 50% PA6 50% standard PES | 30% spiral-crimped PES 70% standard PES |
| Web [g/m$^2$] | 35 | 25 | 40 |
| Web + binder [g/m$^2$] | 41 | 28 | 46 |
| Thermopl. polymer add-on [g/m$^2$] | 12 | 8 | 14 |
| | Primary adherence [N/5 cm] fused at 140° C./12 sec to PES-cotton fabric | | |
| 140° C./12 s/2.5 bar | 13.1 sp | 6.8 sp | 17.6 sp |
| | Post-care adherence [N/5 cm] fused at 120° C./12 sec to PES-cotton fabric | | |
| 1 × 40° C. wash | 11.6 | 7.0 sp | 15.0 sp |
| 1 × 60° C. wash | 9.1 | 6.3 sp | 13.7 sp |
| 1 × dry cleaning | 12.4 sp | 7.3 sp | 12.4 sp |
| | Bonding compound strike-back [N/10 cm] fused at 120° C./12 sec to PES-cotton fabric | | |
| Inner sandwich back-riveting (S-RV) | 0.47 | 0.31 | 1.4 |
| | Stress-strain characteristics | | |
| Maximum tensile force (HZK) along [N/5 cm] | 22 | 11 | 28 |
| Maximum tensile strength elongation (HZKD) along [%] | 21 | 10 | 16 |
| HZK across [N/5 cm] | 4.9 | 1.5 | 6.2 |
| HZKD across [%] | 20 | 8 | 32 |
| Abrasion resistance reverse side | good | almost good | good |

TABLE 2

| | Example 1 | Thermally bonded in comparison with Example 1 |
|---|---|---|
| Web [g/m$^2$] | 35 | 100% PES std. 35 |
| Web + binder [g/m$^2$] | 41 | 40 |
| Polymer add-on [g/m$^2$] | 12 | 12 |
| 140° C./12 s/2.5 bar | 13.1 sp | 11.2 |
| 1 × 60° C. wash | 9.1 mw | 9.0 |
| 1 × dry cleaning | 12.4 sp | 10.1 |
| Inner sandwich back-riveting (S-RV) | 0.47 | 0.27 |
| HZK along [N/5 cm] | 22 | 18 |
| HZKD along [%] | 21 | 8 |
| HZK across [N/5 cm] | 4.9 | 2.9 |
| HZKD across[%] | 20 | 7 |
| Abrasion resistance reverse side | good | good |

It is apparent from the values in the tables that all inventive textile sheet materials are notable for high mechanical strength and high elongation and good abrasion resistance coupled with high delamination resistances. Only the bonding compound strike-back behavior of Example 1 is slightly worse than that of the comparative example. A further advantageous property of the inventive textile sheet materials which is not recited in the table is the substantial smoothness of the surface.

What is claimed is:

1. A method for forming a textile fusible sheet material comprising:

producing a fibrous web from fibers on a laydown apparatus;

applying a mixture of a binder and a thermoplastic polymer to selected areal regions of the fibrous web, the thermoplastic polymer including particles such that the binder penetrates more deeply into the fibrous web and the particles accumulate at a surface, the particles thereby being bound to the fibrous web via the binder and having a free area at the surface available for direct adhesive bonding to a top fabric; and thermally treating the fibrous web so as to dry and bond the fibers of the fibrous web using the binder to form a bonded fibrous web nonwoven fabric and so as to sinter the thermoplastic polymer with a surface of the bonded fibrous web nonwoven fabric.

2. The method as recited in claim 1, wherein the thermally treating includes crosslinking the binder.

3. The method as recited in claim 1, wherein the fibrous web includes at least one of manufactured fibers, binder fibers and natural fibers.

4. The method as recited in claim 3, wherein the manufactured fibers include at least one of polyester, polyamide and regenerated cellulose, and wherein the natural fibers include at least one of wool and cotton fibers.

5. The method as recited in claim 3, wherein the manufactured fibers include crimpable, crimped and/or uncrimpled staple fibers, crimpable, crimped and/or uncrimped directly spun continuous filament fibers or finite fibers.

6. The method as recited in claim 5, wherein the finite fibers include meltdown fibers.

7. The method as recited in claim 1, wherein a fiber linear density of the fibers is <6.7 dtex.

8. The method as recited in claim 1, wherein the thermoplastic polymer includes at least one of polyester-, polyamide-, copolyester-, copolyamide, polyolefin-, polyurethane-, and ethylene vinyl acetate-based polymers.

9. The method as recited in claim 8, wherein the particles have a diameter of less than 500 μm.

10. The method as recited in claim 1, wherein the binder includes at least one of acrylate, styrene-acrylate, ethylene-vinyl acetate, butadiene-acrylate, SBR, NBR and polyurethane type binders.

11. The method as recited in claim 1, wherein the applying of the mixture includes applying the mixture in a form of a dispersion.

12. The method as recited in claim 11, wherein the dispersion includes auxiliaries.

13. The method as recited in claim 12, wherein the auxiliaries include at least one of thickeners, dispersants, wetting agents, flow control agents, hand modifiers and fillers.

14. The method as recited in claim 11, wherein the applying the dispersion includes applying the dispersion using a screen printing process.

15. The method as recited in claim 11, wherein the applying includes applying the mixture in one of a regularly and irregularly distributed pattern of points.

16. The method as recited in claim 11, wherein the particles have a spectrum of particles sizes between >0 μm and 500 μm.

* * * * *